US009100741B2

(12) United States Patent
Akino

(10) Patent No.: US 9,100,741 B2
(45) Date of Patent: Aug. 4, 2015

(54) MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/492,415

(22) Filed: Sep. 22, 2014

(65) Prior Publication Data

US 2015/0117692 A1 Apr. 30, 2015

(30) Foreign Application Priority Data

Oct. 25, 2013 (JP) ..... 2013-222028

(51) Int. Cl.

| | |
|---|---|
| ***H04R 19/04*** | (2006.01) |
| ***H04R 1/04*** | (2006.01) |
| ***H04R 9/08*** | (2006.01) |
| ***H04R 23/00*** | (2006.01) |

(52) U.S. Cl.

CPC .. *H04R 1/04* (2013.01); *H04R 9/08* (2013.01); *H04R 19/04* (2013.01); *H04R 23/004* (2013.01); *H04R 2410/03* (2013.01)

(58) Field of Classification Search

CPC ..... H04R 1/04; H04R 1/086; H04R 9/08; H04R 17/02; H04R 19/04; H04R 19/005; H04R 23/004; H04R 2410/01; H04R 2410/03; H04R 2410/05

USPC ..... 381/174, 91, 92, 113, 355, 356, 357, 381/358, 359, 360, 361, 363, 369, 189

See application file for complete search history.

(56) References Cited

U.S. PATENT DOCUMENTS

| | | | | |
|---|---|---|---|---|
| 8,031,898 | B2 * | 10/2011 | Akino | 381/355 |
| 8,989,421 | B2 * | 3/2015 | Akino | 381/355 |
| 2006/0002575 | A1 * | 1/2006 | Akino | 381/361 |

FOREIGN PATENT DOCUMENTS

| | | | |
|---|---|---|---|
| JP | 4508900 | B2 | 7/2010 |
| JP | 4560424 | B2 | 10/2010 |
| JP | 2012-60490 | A | 3/2012 |

* cited by examiner

*Primary Examiner* — Huyen D Le

(74) *Attorney, Agent, or Firm* — Whitham Curtis Christofferson & Cook, PC

(57) ABSTRACT

A microphone includes an output controller 14 to control output from a microphone unit 10, a metal portion 20 of an outer casing of the microphone, a neon tube 24 to discharge static electricity from an external object through the metal portion 20, and an acoustic coupler 30 to control the output controller 14 through generation of sound in response to a discharge current from the neon tube 24 and detection of the sound.

7 Claims, 2 Drawing Sheets

MICROPHONE

TECHNICAL FIELD

The present invention relates to a microphone that can output audio signals free from noise caused by static electricity.

BACKGROUND ART

If a charged external object such as a human body approaches or touches a microphone, spark discharge occurs between the external object and the microphone. The spark discharge between the external object and the microphone causes noise in audio signals output from the microphone. For example, if a charged human body approaches a microphone, such as a gooseneck microphone, including a sound collector to operate near a mouth, then spark discharge occurs between the human body and the microphone due to a large difference in electrical potential therebetween. Another common problem is the spark discharge between the microphone and a hand of a speaker approaching the microphone for adjusting its position.

The spark discharge occurs when the voltage across the microphone and the human body exceeds the dielectric breakdown voltage of air. In order to eliminate unpleasant noise from output audio signals, the audio signals should be cut off through detection of the static electricity charged in the human body before the occurrence of spark discharge caused by the human body approaching the microphone. Even if some noise occurs in audio signals, a reduction in the audio signal level before the occurrence of spark discharge can minimize adverse effects of the noise.

An exemplary gooseneck microphone that can reduce the noise caused by the contact with a hand is disclosed in Japanese Unexamined Patent Application Publication No. 2012-60490. The gooseneck microphone disclosed in Japanese Unexamined Patent Application Publication No. 2012-60490 includes an external metal cylinder, and an internal cylinder disposed inside the external cylinder and electrically connected to the shielded wire of a microphone cable and the ground pattern of a circuit board. The external cylinder is covered with a cylindrical resin cover. The resin cover has a high volume resistivity. The gooseneck microphone disclosed in Japanese Unexamined Patent Application Publication No. 2012-60490 thus can slow down the charge transfer to reduce the noise caused by the discharge upon the hand contact.

Japanese Patent No. 4508900 discloses a microphone including a means for reducing the noise caused by vibrations of a microphone case to mute the output of audio signals through detection of the vibrations, for example. The means for reducing the vibration noise includes a piezoelectric bimorph element to generate electricity in response to vibrations, a light emitting means to emit light based on the electromotive force of the piezoelectric bimorph element, and a photoconductive element to experience a reduction in resistance after reception of the light from the light emitting means. The microphone disclosed in Japanese Patent No. 4508900 can reduce (mute) the output level of audio signals through a reduction in the resistance of the photoconductive element.

Japanese Patent No. 4560424 discloses a condenser microphone that can reduce the audio output if detecting electromagnetic waves, to reduce or suppress unpleasant noise, for example. In the microphone disclosed in Japanese Patent No. 4560424, a light emitting means emits light in response to detection of high frequency, and a photoconductive element experiences a reduction in resistance after reception of the light, to reduce the audio output.

The microphone disclosed in Japanese Patent No. 4508900 reduces the noise caused by vibrations. The microphone disclosed in Japanese Patent No. 4560424 reduces the noise caused by electromagnetic waves. In other words, neither of the microphones disclosed in Japanese Patent Nos. 4508900 and 4560424 cannot reduce the noise caused by static electricity.

The microphone disclosed in Japanese Unexamined Patent Application Publication No. 2012-60490 reduces the occurrence of noise caused by the discharge upon the contact with a hand. According to Japanese Unexamined Patent Application Publication No. 2012-60490, the noise caused by the discharge is reduced through slowing down the charge transfer upon the hand contact, rather than through the electrical isolation of the route of the discharge upon the hand contact from a circuit for outputting audio signals. Unfortunately, the microphone disclosed in Japanese Unexamined Patent Application Publication No. 2012-60490 cannot completely avoid the occurrence of the noise caused by the discharge.

SUMMARY OF INVENTION

Technical Problem

An object of the invention is to provide a microphone that can certainly prevent the noise caused by the discharge upon the contact with a hand from entering a circuit for outputting audio signals through electrical isolation of the noise from the audio signals.

Solution To Problem

A microphone according to the invention includes: a microphone unit; an outer casing including a metal portion, the outer casing housing the microphone unit; a neon tube to discharge static electricity from an external object through the metal portion; an output controller to control output from the microphone unit; and an acoustic coupler to generate control signals based on a current of the electricity discharged by the neon tube and to transmit the control signals to the output controller.

Advantageous Effects Of Invention

According to the invention, if a charged external object such as a human body approaches the metal portion of the microphone, the neon tube discharges static electricity from the external object through the metal portion. In response to the discharge of the neon tube, the acoustic coupler transmits control signals to the output controller. In response to the transmitted control signals, the output controller controls the output from the microphone unit. The invention can thus eliminate the unpleasant noise caused by the discharge from output audio signals.

DESCRIPTION OF EMBODIMENTS

A microphone according to an embodiment of the invention will now be described with reference to the drawings.

EXAMPLES

Figure 1:
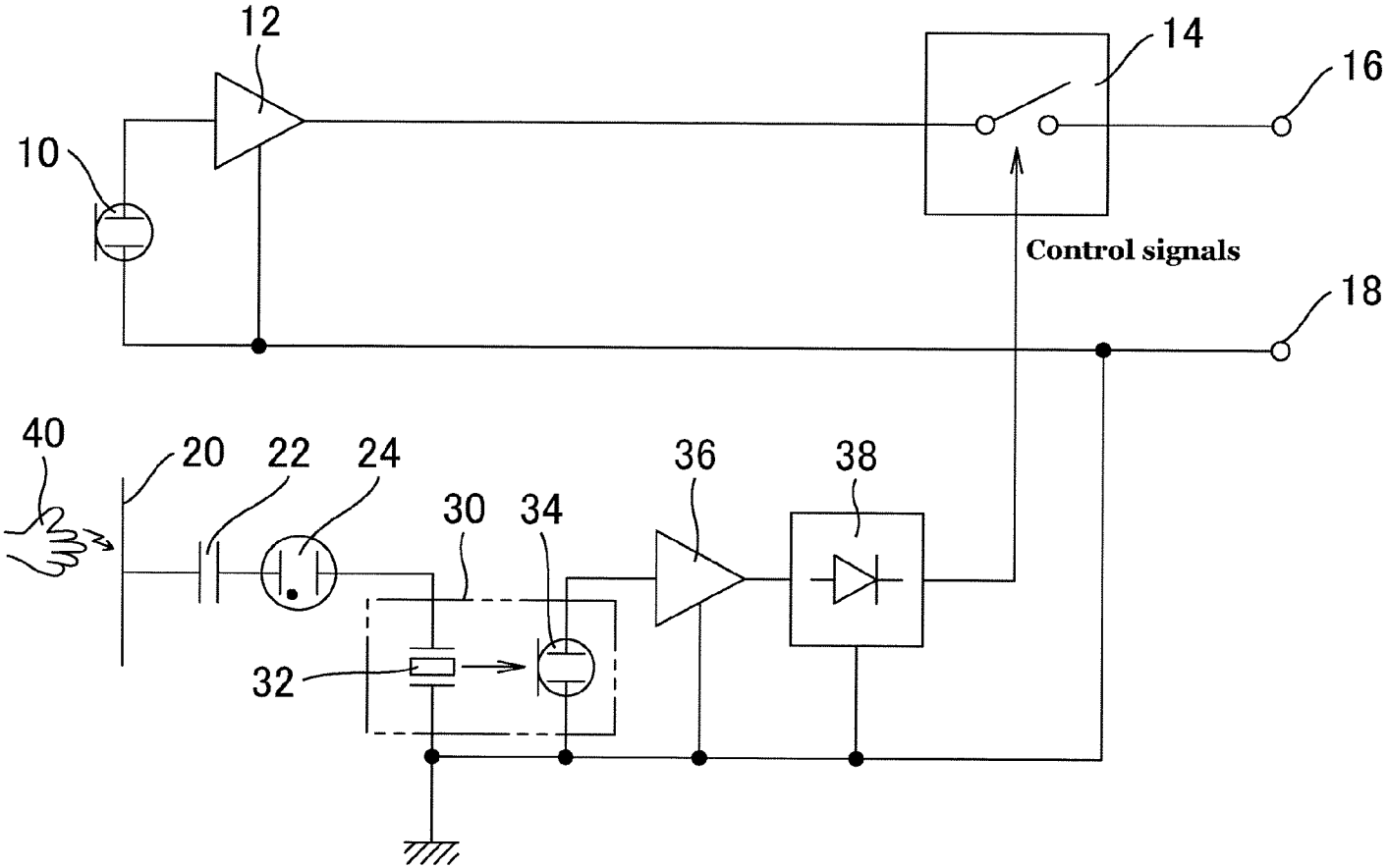
FIG. 1 is a circuit diagram illustrating a microphone according to an embodiment of the invention.

In the circuit illustrated in FIG. 1, a microphone unit 10 may be a voice microphone unit of any type of electroacoustic conversion.

FIG. 1 illustrates an exemplary circuit including the microphone unit 10 consisting of an electret condenser microphone unit. With reference to FIG. 1, the audio signals generated through the electroacoustic conversion by the microphone unit 10 are amplified by the amplifier 12, and are output from output terminals 16 and 18 to the outside of the microphone. An output controller 14 is connected between the output end of the amplifier 12 and the output terminal 16.

The output controller 14 turns on or off (passes or cuts off) the output from the amplifier 12 in response to control signals input to the output controller 14. In other words, the output controller 14 controls the output of the audio signals. It is noted that the output controller 14 may continuously or stepwise control the level of the output from the microphone unit 10 through the amplifier 12.

The control signals are generated in a circuit of the microphone described below.

Figure 2:
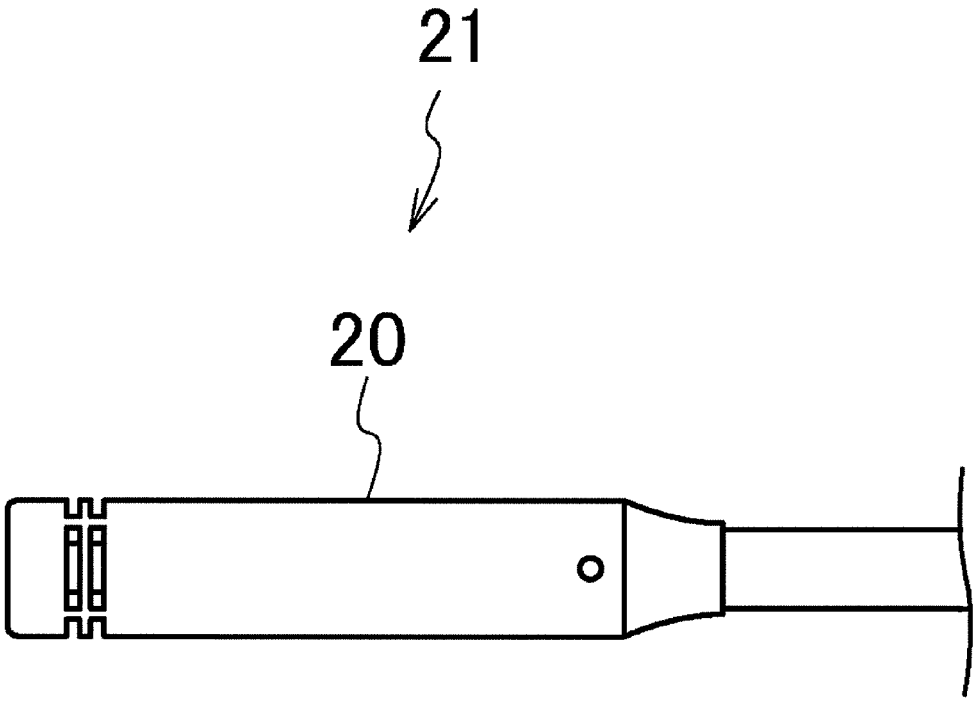
FIG. 2 is a side view of an exemplary appearance of a microphone according to the invention.

FIG. 2 is a side view of an exemplary appearance of the microphone. The microphone includes a casing 21 that houses the microphone unit 10. The casing 21 at least partly includes a metal portion 20.

Referring back to FIG. 1, a capacitor 22, a neon tube 24, and a sound generator 32 are connected in series between the metal portion 20 of the microphone and the ground.

The sound generator 32 consists of a piezoelectric sounding body including a piezoelectric element, according to the embodiment. The sound generator 32 functions as an acoustic coupler 30 in association with a sound detector 34. If an external object, such as a hand 40 of a human, charged with static electricity approaches or touches the metal portion 20, the neon tube 24 discharges due to a potential difference between the charged hand 40 and the metal portion 20.

The neon tube 24 is a sealed glass tube containing mixed gas of neon and argon and a pair of electrodes. Under voltage applied across the electrodes, the Penning effect causes the neon tube 24 to emit light through the cathode glow discharge even under low voltage. The neon tube 24 discharges even if the potential difference is approximately 50 V between the electrodes. A typical example utilizing such characteristics of a neon tube is an electroscope. A neon tube included in a typical electroscope produces a low current of approximately 1.5 to 5 pA and a small amount of light during the discharge. The neon tube 24 has a high internal resistance before the start of discharge. The internal resistance, however, decreases after the start of discharge, and the discharge current increases with the decrease in the internal resistance.

A high-resistance resistor or a capacitor connected in series to the neon tube 24 defines a neon-tube oscillator circuit. In other words, the circuit portion including the capacitor 22 connected in series to the neon tube 24 in FIG. 1 serves as a neon-tube oscillator circuit. This circuit portion is further connected in series to the sound generator 32 including a piezoelectric element, as illustrated in FIG. 1. In the circuit illustrated in FIG. 1, the oscillation of the neon-tube oscillator circuit causes the sound generator 32 to output audio signals.

The neon tube 24 emits only a small amount of light in response to the discharge; hence, it is difficult to utilize the light emitted from the neon tube 24 for the control of the level of audio signals by a photoconductive element in the disclosures in Japanese Patent Nos. 4508900 and 4560424. According to the embodiment illustrated in FIG. 1, the output controller 14 is controlled by the sound detector 34 that defines the acoustic coupler 30 in association with the sound generator 32. In specific, the sound generator 32 generates audio signals in response to the discharge of the neon tube 24. The generated audio signals are detected by the sound detector 34. The sound detector 34 then generates control signals for controlling the output controller 14 on the basis of the audio signals.

The sound detector 34 detects the audio signals through any detection technique. The sound detector 34 includes a detector microphone, according to the embodiment illustrated in FIG. 1. The detector microphone may be of any type, for example, the same type as the voice microphone unit 10.

The control signals generated by the sound detector 34 are amplified by an amplifier 36, are rectified by diodes 38, and are input into the output controller 14. The output controller 14 includes, for example, an analogue switch. The output controller 14 may be configured to turn off the output from the microphone while receiving the control signals from the acoustic coupler 30 through the diodes 38, and to turn on the output while receiving no signal from the acoustic coupler 30.

Alternatively, the output controller 14 may include a level control circuit. In this case, the output controller 14 may reduce the output level of audio signals while receiving the control signals from the acoustic coupler 30 through the diodes 38. The level control circuit may include a photoconductive element as is disclosed in Japanese Patent No. 4508900 or 4560424.

The operations of the microphone according to the embodiment when a hand 40 of a human charged with static electricity approaches the metal portion 20 of the casing 21 of the microphone will now be explained. If the neon tube 24 was not connected to the metal portion 20, the static electricity in the human body would be discharged through the spark discharge between the hand 40 and the metal portion 20. The spark discharge is caused by the dielectric breakdown of the air between the hand 40 and the metal portion 20, and thus requires a considerably high voltage across the hand 40 and the metal portion 20.

In contrast, according to the embodiment illustrated in FIG. 1, the neon tube 24, which discharges under lower voltage than that required for the spark discharge, is connected to the metal portion 20 via the capacitor 22. The neon tube 24 generates glow discharge due to the potential difference between the hand 40 charged with static electricity and the metal portion 20 before the occurrence of spark discharge, according to the embodiment illustrated in FIG. 1. The glow discharge of the neon tube 24 causes a current of the electricity charged in the human body to flow through the hand 40, the metal portion 20, the capacitor 22, the neon tube 24, and the sound generator 32.

The current flowing through the sound generator 32 activates the sound generator 32 to emit sound. The sound is detected and converted into control signals by the sound detector 34. The control signals are amplified by the amplifier 36, rectified by the diodes 38, and input into the output controller 14. The control signals input in the output controller 14 control the output controller 14.

The output controller 14 cuts off or reduces the audio signals output from the microphone unit 10 through the amplifier 12, during the discharge of the neon tube 24. The microphone according to the embodiment can thus output audio signals free from unpleasant noise caused by the discharge.

The circuit portion including the metal portion 20, the capacitor 22, the neon tube 24, and the sound generator 32 to the ground substantially define an electroscope. The neon tube 24 included in the electroscope can respond to the voltage caused by static electricity, to start discharge at a smaller potential difference than that required for spark discharge. The neon tube 24 thus can detect static electricity charged in an external object such as a human body before the occurrence of the spark discharge. The detected electricity is converted into control signals, which can control the output controller 14 to reduce noise.

According to the embodiment, the circuit for detecting static electricity charged in an external object such as a human body is electrically isolated by the acoustic coupler 30, from an audio output system of the microphone that includes the output controller 14 for controlling the level of audio signals output from the microphone unit 10, and from a control signal system (the amplifier 36 and the diodes 38) for supplying control signals to the output controller 14.

This configuration according to the embodiment can prevent the noise caused by the discharge of static electricity from entering the circuit for outputting audio signals.

According to the embodiment, the static electricity charged in an external object such as a human body is detected by utilizing the discharge of the neon tube 24. In an alternative embodiment of the invention, the output of audio signals from the microphone may be turned on or off or controlled to a certain level through the optical coupling utilizing the light emitted from the neon tube 24 during the discharge. It is noted that the intensity of light emitted from the neon tube 24 may be insufficient for the optical coupling. For stable operation of the output controller 14, the output controller 14 should preferably be controlled by the acoustic coupler 30 operating in response to the discharge of the neon tube 24, as in the embodiment illustrated in the drawings.

The invention claimed is:

1. A microphone comprising:

a microphone unit;

an outer casing comprising a metal portion, the outer casing housing the microphone unit;

a neon tube to discharge static electricity from an external object through the metal portion;

an output controller to control output from the microphone unit; and an acoustic coupler to generate control signals based on a current of the electricity discharged by the neon tube and to transmit the control signals to the output controller.

2. The microphone according to claim 1, wherein the acoustic coupler comprises a sound generator and a sound detector.

3. The microphone according to claim 2, wherein the sound generator converts the current from the neon tube into audio signals, and the sound detector detects the audio signals and converts the audio signals into the control signals.

4. The microphone according to claim 3, wherein the output controller comprises a switch to turn on or off the output from the microphone unit in response to the control signals transmitted from the acoustic coupler.

5. The microphone according to claim 3, wherein the output controller controls a level of the output from the microphone unit in response to the control signals transmitted from the acoustic coupler.

6. The microphone according to claim 3, wherein the sound generator comprises a piezoelectric sounding body.

7. The microphone according to claim 3, wherein the sound detector comprises a detector microphone.

* * * * *